US008967382B2

(12) United States Patent
Liu

(10) Patent No.: US 8,967,382 B2
(45) Date of Patent: Mar. 3, 2015

(54) ELECTRONIC CIGARETTE BOX

(71) Applicant: Qiuming Liu, Guangdong (CN)

(72) Inventor: Qiuming Liu, Guangdong (CN)

(73) Assignee: Kimree Hi-Tech Inc, Road Town, Tortola (VG)

( * ) Notice: Subject to any disclaimer, the term of this patent is extended or adjusted under 35 U.S.C. 154(b) by 0 days.

(21) Appl. No.: 13/910,211

(22) Filed: Jun. 5, 2013

(65) Prior Publication Data

US 2014/0299491 A1 Oct. 9, 2014

Related U.S. Application Data

(63) Continuation of application No. PCT/CN2013/073953, filed on Apr. 9, 2013.

(51) Int. Cl.
*B65D 69/00* (2006.01)
*A24F 15/18* (2006.01)

(52) U.S. Cl.
CPC ..... *A24F 15/18* (2013.01); *Y10S 206/818* (2013.01)
USPC ..... 206/581; 206/236; 206/265; 206/818

(58) Field of Classification Search
USPC ..... 206/37, 38, 216, 223, 235, 236, 242, 206/265, 581, 818; 131/329, 347
See application file for complete search history.

(56) References Cited

U.S. PATENT DOCUMENTS

| | | | | |
|---|---|---|---|---|
| 3,139,212 | A * | 6/1964 | Stallard | 220/256.1 |
| 4,555,020 | A * | 11/1985 | Campello et al. | 206/235 |
| 4,583,939 | A * | 4/1986 | Brickwedde | 431/253 |
| 5,005,697 | A * | 4/1991 | Jimbo et al. | 206/235 |
| 5,330,056 | A * | 7/1994 | de la Rocha | 206/581 |
| 5,513,754 | A * | 5/1996 | Chang | 206/581 |
| 6,016,916 | A * | 1/2000 | Ortner | 206/581 |
| 2007/0108093 | A1 * | 5/2007 | Park et al. | 206/581 |
| 2010/0243754 | A1 * | 9/2010 | Harris | 239/34 |

FOREIGN PATENT DOCUMENTS

| | | |
|---|---|---|
| CN | 201030986 Y | 3/2008 |
| CN | 201484891 U | 5/2010 |
| CN | 201571500 U | 9/2010 |
| CN | 202340818 U | 7/2012 |

(Continued)

OTHER PUBLICATIONS

International Search Report and Written Opinion mailed Jan. 23, 2014 for International Application No. PCT/CN2013/073953 filed Apr. 9, 2013.

*Primary Examiner* — Luan K Bui
(74) *Attorney, Agent, or Firm* — Tim Tingkang Xia, Esq.; Morris, Manning & Martin, LLP

(57) ABSTRACT

An electronic cigarette box is provided, comprising a box body, a box cover connected with the box body, an electronic cigarette container received in the box body, wherein, the box body defines a holding cavity, a bottle is received in the holding cavity, and the bottle contains perfume, air fresheners, deodorant or medicine. When the electronic cigarette box generates peculiar smell after a long time of use, a user can spray appropriate perfume into the electronic cigarette box to dispel the peculiar smell; the body of the user may have residual smoke smell when he/she has smoked the electronic cigarette a short time ago, the user can take out the perfume bottle and spray some perfume onto his/her body, thereby burnishing the user's image and improving the user's experience; the bottle can also received medicine, the user can be treated timely when feeling uncomfortable or illness due to smoking.

7 Claims, 4 Drawing Sheets

(56) References Cited

FOREIGN PATENT DOCUMENTS

| | | | |
|---|---|---|---|
| CN | 102921030 | A | 2/2013 |
| GB | 275910 | A | 8/1927 |
| JP | 2001346565 | A | 12/2001 |
| WO | 2004019710 | A1 | 3/2004 |

* cited by examiner

ELECTRONIC CIGARETTE BOX

CROSS-REFERENCE TO RELATED APPLICATIONS

This application is a continuation of International Patent Application No. PCT/CN2013/073953, with an international filing date of Apr. 9, 2013, designating the United States, now pending. The contents of these specifications are incorporated herein by reference.

FIELD OF THE INVENTION

The present invention relates to the field of electronic cigarette technology, and more particularly, relates to an electronic cigarette box.

BACKGROUND OF THE INVENTION

Smoking is bad for health, with the improvement of people's health consciousness more and more persons know the danger of smoking. Smoking does not only hurt bodies of smokers themselves, but also hurts persons around smokers. Nowadays a type of electronic cigarette is manufactured, a shape of such an electronic cigarette is similar to that of an ordinary cigarette, when the electronic cigarette is smoked, smoke is generated, however the smoke does not include toxic substances such as tar, etc., so the electronic cigarette is healthier than the ordinary cigarette.

Electronic cigarettes are equipped with electronic cigarette boxes configured to receive the electronic cigarettes. Persons take out the electronic cigarettes from the electronic cigarette boxes when smoking. However, the existing electronic cigarette boxes have these drawbacks: peculiar smell maybe generated in the electronic cigarette boxes after a long time of use; bodies of users who have smoked electronic cigarettes a short time ago may send out smell of smoke, which may adversely affect the users' images; furthermore, some users may feel uncomfortable or get ill because smoking, and they are difficult to be treated timely.

SUMMARY OF THE INVENTION

The objective of the present invention is to provide an electronic cigarette box which is provided with a holding cavity, a perfume bottle or air fresheners can be placed in the holding cavity for dispelling peculiar smell and improving user experience, aiming at the above-mentioned drawbacks of having peculiar smell inside the existing electronic cigarette box.

The technical solutions of the present invention for solving the technical problems are as follows:

An electronic cigarette box is provided, which comprises a box body, a box cover connected with the box body, an electronic cigarette container received in the box body, the box body defines a holding cavity, a bottle is received in the holding cavity, and the bottle contains perfume, air fresheners, deodorant or medicine.

Advantageously, the bottle includes a bottle body and a bottle cap, the bottle body is placed in the holding cavity, and a flexible lining configured to fix the bottle body is mounted on an inner wall of the holding cavity.

Advantageously, a shape of the bottle body is matched with a shape of the holding cavity with the flexible lining.

Advantageously, the flexible lining is made of polyethylene foam or polyurethane foam.

Advantageously, the bottle includes a bottle body and a bottle cap, the bottle body is placed in the holding cavity, a bulge is formed at a part of the box cover corresponding to the bottle cap, the bulge resists an end surface of the bottle cap when the box cover and the box body are closed.

Advantageously, the bottle includes a bottle body and a bottle cap, a first magnetic material is mounted on a bottom of the bottle body, a second magnetic material is mounted on an area of the holding cavity that is in contact with the bottle body, and the first magnetic material of the bottle body and the second magnetic material of the holding cavity attract each other due to magnetism, thereby fastening the bottle in the holding cavity.

Advantageously, the holding cavity is defined in one side of the box body near the box cover.

Advantageously, a shape of the holding cavity is any one of circle, polygons and oval.

Advantageously, a circuit control device and a power supply electrically connected with the circuit control device are received in the box body.

Advantageously, a control switch is installed in the circuit control device, and the control switch is electrically connected with the circuit control device.

When implementing the electronic cigarette box of the present invention, the following advantageous effects can be achieved: the box body defines the holding cavity, the bottle is received in the holding cavity, and the bottle contains perfume or air fresheners; when the electronic cigarette box generates peculiar smell after a long time of use, a user can spray appropriate perfume into the electronic cigarette box to dispel the peculiar smell; the body of the user may have residual smoke smell when he/she has smoked the electronic cigarette a short time ago, the user can take out the perfume bottle and spray some perfume onto his/her body, thereby burnishing the user's image and improving the user's experience; the bottle can also received medicine, the user can be treated timely when feeling uncomfortable or illness due to smoking, which brings great convenience to the user, and user's experiences is improved.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

To make the technical feature, objective and effect of the present invention be understood more clearly, now the specific implementation of the present invention is described in detail with reference to the accompanying drawings and embodiments.

Figure 1:
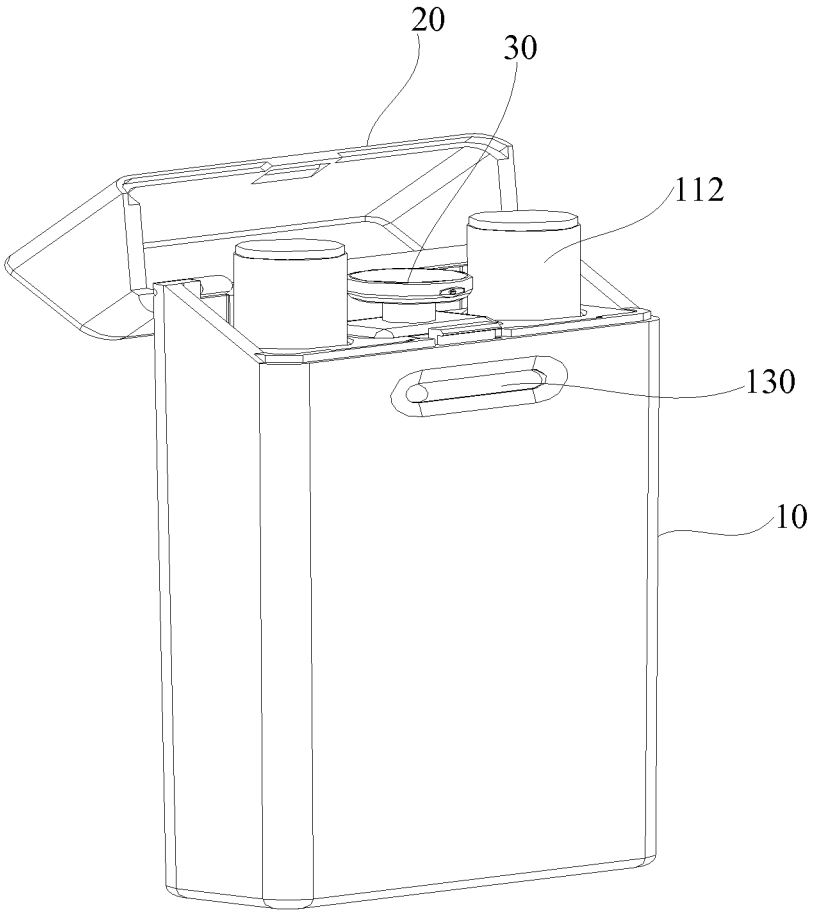
FIG. 1 is a schematic view of an electronic cigarette box with an electronic cigarette received therein, according to a preferred embodiment of the present invention.
Figure 2:
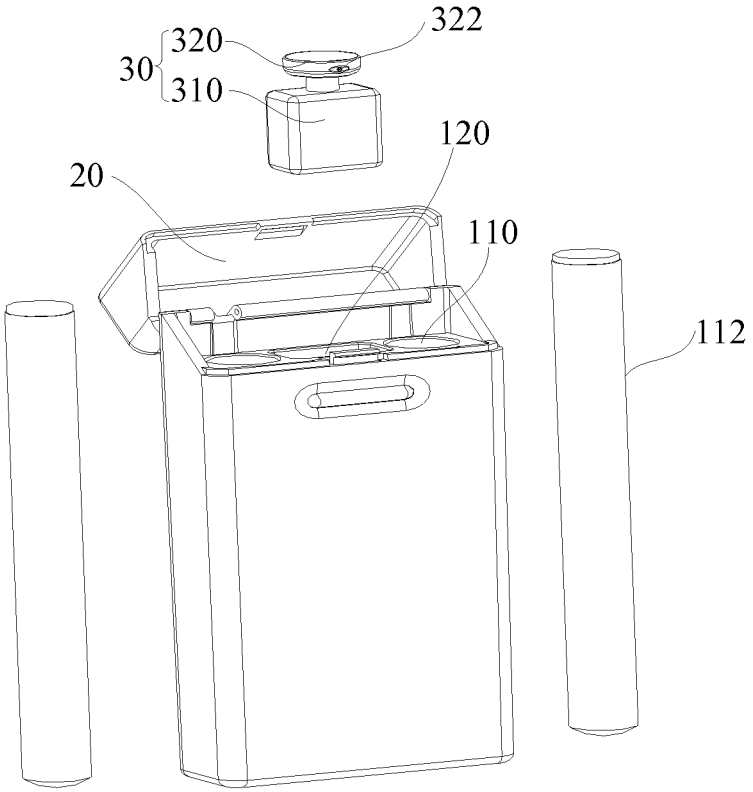
FIG. 2 is a disassembled view of FIG. 1.

As shown in FIG. 1 and FIG. 2, an electronic cigarette box in accordance with a preferred embodiment of the present invention comprises a box body 10 and a box cover 20.

Wherein, the box body 10 and the box cover 20 are connected together by a hinge (not shown), and the box body 10 and the box cover 20 are sealed to form the electronic cigarette box by a snap buckle.

An electronic cigarette container 110 is received in the box body 10, and the electronic cigarette 112 is inserted into the electronic cigarette container 110. In the specific embodiment, there is a one-to-one correspondence between the electronic cigarette container 110 and the electronic cigarette 112, and the number of the electronic cigarette container 110 can be one or more. The electronic cigarette 112 inserted into the electronic cigarette container 110 can be a disposable electronic cigarette or a reusable electronic cigarette.

A circuit control device and a power supply electrically connected with the circuit control device are received in the box body 10. A control switch 130 is installed in the circuit control device, the control switch 130 is electrically connected with the circuit control device, and the control switch 130 is used to control the box cover 20 to be opened and closed. The electronic cigarette box of the embodiment can be controlled by a switch automatically. When users press the control switch 130, the box cover 20 is opened automatically; after taking out the electronic cigarette 112, the users press the control switch 130 again, and the box cover 20 will be closed automatically. There is no need to manually open the box cover 20, and it is easy to use the electronic cigarette box.

Figure 3:
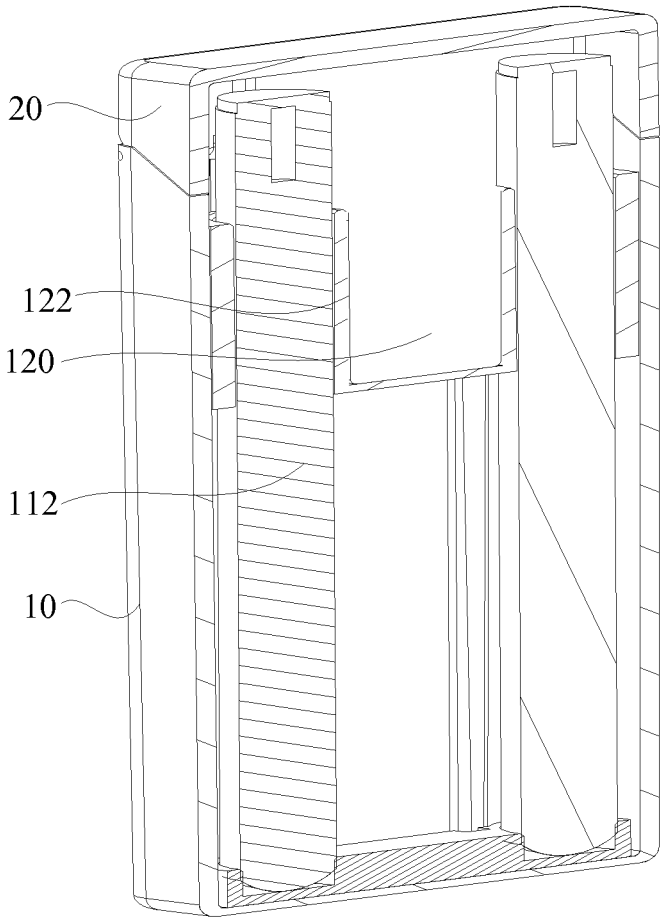
FIG. 3 is a cutaway view of an electronic cigarette box with an electronic cigarette received therein, according to a first embodiment of the present invention.

As shown in FIG. 3, the box body 10 defines a holding cavity 120, the holding cavity 120 is defined in one side of the box body 10 near the box cover 20, a bottle 30 is received in the holding cavity 120. The bottle 30 includes a bottle body 310 and a bottle cap 320, wherein the bottle body 310 is placed in the holding cavity 120. In one embodiment, a flexible lining 122 is mounted on an inner wall of the holding cavity 120, the flexible lining 122 has good elastic-plastic and toughness, and can be distorted without breaking. The flexible lining 22 is configured to fix the bottle body 310, and a shape of the bottle body 310 is matched with a shape of the holding cavity 120. Specifically, the flexible lining 122 is made of polyethylene foam or polyurethane foam, and can also be made of other flexible materials.

Figure 4:
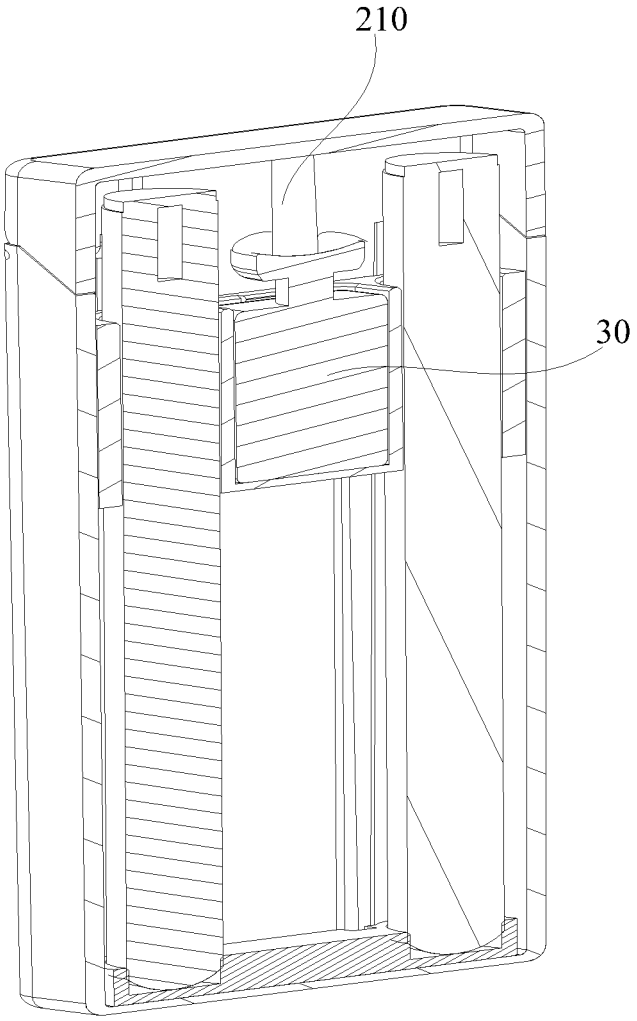
FIG. 4 is a cutaway view of an electronic cigarette box with an electronic cigarette received therein, according to a second embodiment of the present invention.

As shown in FIG. 4, in another embodiment of the present invention, a bulge 210 is formed on the box cover 20. The bulge 210 is fixed on an inner wall of the box cover 20 through welding, thread connection or adhesives. The bulge 210 is corresponding to the bottle cap 320. When the box body 10 is covered with the box cover 20, the bulge 210 formed on the box cover 20 resists an end surface of the bottle cap 320, so the bottle body 310 is fixed in the holding cavity 120. When the electronic cigarette box is carried, the liquid received in the bottle 30 can be prevented from spilling due to shaking. The holding cavity 120 is formed between the two electronic cigarettes 112 or formed at one side of the electronic cigarette 112. A shape of the holding cavity 120 can be any one of circle, polygons (parallelogram, hexagon or pentagon) or oval according to the shape of the bottle 30.

In the third embodiment, a first magnetic material (not shown) is mounted on a bottom of the bottle body 310, a second magnetic material (not shown) is mounted on an area of the holding cavity 120 that is in contacted with the bottle body 310, and the first magnetic material of the bottle body 310 and the second magnetic material of the holding cavity 120 attract each other due to magnetism, thereby fastening the bottle body 310 in the holding cavity 120, and avoiding shaking of the bottle 30.

In the above-mentioned embodiment, the bottle 30 is a perfume bottle, a size of the perfume bottle should be matched with a size of the holding cavity 120 for preventing the liquid received in the bottle 30 from spilling due to instability perfume bottle. An ejection head 322 is formed in the perfume bottle, and the ejection head 322 is used to spray perfume. When the electronic cigarette box has peculiar smell, a user can take out the perfume bottle and spray some perfume into the electronic cigarette box to dispel the peculiar smell; and when a user will be presented at important occasion after smoking, it is convenient to spray perfume onto user's body, and user's experiences is improved.

In another embodiment, the bottle 30 also contains air fresheners or deodorant for clearing the electronic cigarette box or dispelling peculiar smell of the electronic cigarette box.

The box body 10 defines a holding cavity 120, a bottle 30 is received in the holding cavity 120, and the bottle 30 contains perfume or air fresheners; when the electronic cigarette box generates peculiar smell after a long time of use, a user can spray appropriate perfume into the electronic cigarette box to dispel peculiar smell; the body of the user may have residual smoke smell when he/she has smoked the electronic cigarette a short time ago, the user can take out perfume bottle and spray some perfume onto his/her body, thereby burnishing the user's image and improving user's experience; the bottle 30 can also received medicine, the user can be treated timely when feeling uncomfortable or in poor health due to smoking, which brings great convenience to user, and user's experiences is improved.

While the embodiments of the present invention are described with reference to the accompanying drawings above, the present invention is not limited to the above-mentioned specific implementations. In fact, the above-mentioned specific implementations are intended to be exemplary not to be limiting. In the inspiration of the present invention, those ordinary skills in the art can also make many modifications without breaking away from the subject of the present invention and the protection scope of the claims. All these modifications belong to the protection of the present invention.

What is claimed is:

1. An electronic cigarette box, comprising a box body, a box cover connected with the box body, an electronic cigarette container received in the box body, wherein, the box body defines a holding cavity, a bottle is received in the holding cavity, and the bottle contains perfume, air fresheners, deodorant or medicine; the bottle includes a bottle body and a bottle cap, the bottle body is placed in the holding cavity, and a flexible lining configured to fix the bottle body is mounted on an inner wall of the holding cavity; a shape of the bottle body is matched with a shape of the holding cavity with the flexible lining; a bulge is formed at a part of the box cover corresponding to the bottle cap through welding, thread connection or adhesives, the bulge resists an end surface of the bottle cap when the box cover and the box body are closed.

2. The electronic cigarette box according to claim 1, wherein, the flexible lining is made of polyethylene foam or polyurethane foam.

3. The electronic cigarette box according to claim 1, wherein, the bottle includes a first magnetic material is mounted on a bottom of the bottle body, a second magnetic material is mounted on an area of the holding cavity that is in contact with the bottle body, and the first magnetic material of the bottle body and the second magnetic material of the holding cavity attract each other due to magnetism, thereby fastening the bottle in the holding cavity.

4. The electronic cigarette box according to claim 1, wherein, the holding cavity is defined in one side of the box body near the box cover.

5. The electronic cigarette box according to claim 1, wherein, a shape of the holding cavity is any one of circle, polygons and oval.

6. The electronic cigarette box according to claim 1, wherein, a circuit control device and a power supply electrically connected with the circuit control device are received in the box body.

7. The electronic cigarette box according to claim 6, wherein, a control switch is installed in the circuit control device, and the control switch is electrically connected with the circuit control device.

* * * * *